US012788116B2

(12) United States Patent
Bouchet

(10) Patent No.: US 12,788,116 B2
(45) Date of Patent: Nov. 10, 2026

(54) INTERCHANGEABLE BUCKLE DEVICE

(71) Applicant: Harry Winston SA, Plan-les-Ouates (CH)

(72) Inventor: Aurélien Bouchet, Sornard (CH)

(73) Assignee: Harry Winston SA, Plan-les-Ouates (CH)

( * ) Notice: Subject to any disclaimer, the term of this patent is extended or adjusted under 35 U.S.C. 154(b) by 169 days.

(21) Appl. No.: 18/734,035

(22) Filed: Jun. 5, 2024

(65) Prior Publication Data

US 2024/0407506 A1 Dec. 12, 2024

(30) Foreign Application Priority Data

Jun. 6, 2023 (EP) ..... 23177457

(51) Int. Cl.
*A44B 11/00* (2006.01)
*A44B 11/25* (2006.01)

(52) U.S. Cl.
CPC ..... *A44B 11/258* (2013.01)

(58) Field of Classification Search
CPC ..... A44B 11/006; A44B 11/20; A44B 11/22; A44B 11/223; A44B 11/226; A44B 11/24; A44C 5/145; A44C 5/14; A44C 5/147; A44C 5/2028; A44C 5/20; Y10T 24/4065; Y10T 24/406; Y10T 24/4037; Y10T 24/4736; Y10T 24/4782
See application file for complete search history.

(56) References Cited

U.S. PATENT DOCUMENTS 1,024,830 A * 4/1912 Cook ..... A44B 11/24 24/178
1,569,507 A * 1/1926 Lederer ..... A44B 11/24 24/178
1,692,809 A * 11/1928 Bigney ..... A44C 5/14 59/79.3
1,763,100 A * 6/1930 Mendosa ..... A44B 11/24 24/163 R (Continued)

FOREIGN PATENT DOCUMENTS

CH 713108 A2 * 5/2018 ..... A44C 5/145
CH 714260 A2 * 4/2019 ..... A44C 5/14

(Continued)

OTHER PUBLICATIONS

Japanese Office Action issued Apr. 15, 2025, in corresponding Japanese Patent Application No. 2024-088542 (with English Translation), 9 pages.

(Continued)

*Primary Examiner* — Jason W San
*Assistant Examiner* — Anna S Rashid
(74) *Attorney, Agent, or Firm* — Oblon, McClelland, Maier & Neustadt, L.L.P.

(57) ABSTRACT

An interchangeable buckle device including a buckle provided with a bar around which a tongue is articulated, the device including an insert provided with a channel arranged to receive the bar, and a latch arranged to cooperate with the insert so as to close the channel, the latch being arranged to move from a locked position in which the bar is held in the channel to an open position in which the bar is free, the latch being held in its locked position by a resilient return.

12 Claims, 2 Drawing Sheets

(56) References Cited

U.S. PATENT DOCUMENTS 2,629,104 A * 2/1953 Easlick ..... A44B 11/008 2/322
2,806,275 A * 9/1957 Stoll ..... A44B 11/006 24/265 BC
3,432,895 A * 3/1969 Yost ..... A44B 11/006 24/265 R
4,406,043 A * 9/1983 Friedman ..... A44B 11/006 24/182
4,414,714 A * 11/1983 Kostanecki ..... A44C 5/20 224/175
4,419,792 A * 12/1983 Kohli ..... A44B 11/24 24/191
4,458,390 A * 7/1984 Fogelson ..... A44B 11/12 24/182
4,858,283 A * 8/1989 Takeuchi ..... A44B 11/24 24/178
5,323,516 A * 6/1994 Hartmann ..... A44C 5/2071 24/303
5,914,913 A * 6/1999 Shriqui ..... A44C 5/14 368/282
5,951,193 A * 9/1999 Yamamoto ..... A44C 5/105 368/282
6,108,821 A * 8/2000 Malsoute ..... A44B 11/008 2/338
6,145,169 A * 11/2000 Terzuola ..... A44B 11/005 24/191
6,272,836 B1 * 8/2001 Fat ..... A44C 5/107 59/80
7,480,967 B2 * 1/2009 Kojoori ..... G04B 37/1486 2/322
8,365,364 B2 * 2/2013 Labelson ..... A44B 11/006 24/316
9,173,454 B2 * 11/2015 Liu ..... A44B 11/006
9,498,029 B2 * 11/2016 Schooley ..... G04B 37/1486
9,930,936 B2 * 4/2018 Liu ..... A41F 9/002
10,021,945 B2 * 7/2018 Rohrbach ..... A44B 11/24
10,624,425 B2 * 4/2020 Chen ..... A44B 11/226
10,691,073 B2 * 6/2020 Nicolas ..... A44C 5/145
10,809,666 B2 * 10/2020 Markan ..... A44C 5/14
10,820,669 B2 * 11/2020 Chen ..... G04B 37/1486
10,827,807 B2 * 11/2020 Li ..... G04B 37/1486
10,856,625 B1 * 12/2020 Weng ..... A44B 11/2542
10,939,732 B2 * 3/2021 Dong ..... A44B 11/24
11,129,449 B2 * 9/2021 Wang ..... A41F 9/002
11,219,278 B1 * 1/2022 Ting ..... A44B 11/001
11,324,287 B2 * 5/2022 Wang ..... A44B 11/06
11,375,778 B1 * 7/2022 Zinnbauer ..... A44B 11/2592
11,464,301 B2 * 10/2022 Pesenti ..... G04B 37/1493
11,559,119 B2 * 1/2023 Shi ..... A44C 5/14
11,974,641 B2 * 5/2024 Li ..... A44C 5/2042
12,055,898 B2 * 8/2024 Loetscher ..... G04B 37/1486
12,082,657 B2 * 9/2024 Rowland ..... A44B 11/12
12,245,665 B2 * 3/2025 Ravelli ..... A44B 11/24
12,303,000 B2 * 5/2025 Schaller ..... A44C 5/14
2003/0182777 A1 * 10/2003 Kim ..... A44B 11/006 24/615
2007/0130735 A1 * 6/2007 Diamond ..... A44B 11/24 24/636
2012/0240361 A1 * 9/2012 Leger ..... A44C 5/246 24/265 EC
2014/0215766 A1 * 8/2014 Liu ..... A44B 11/006 24/188
2015/0040356 A1 * 2/2015 Chang ..... A44B 11/22 24/188
2016/0021985 A1 * 1/2016 Liu ..... A44B 11/006 2/322
2016/0262504 A1 * 9/2016 Schooley ..... G04B 37/1486
2017/0035158 A1 * 2/2017 Schooley ..... A44C 5/2057
2017/0258186 A1 * 9/2017 Schooley ..... G04B 37/1486
2019/0064744 A1 * 2/2019 Nicolas ..... A44C 5/2028
2020/0085149 A1 * 3/2020 Soung ..... A44B 11/16
2020/0142358 A1 * 5/2020 Taniguchi ..... A44C 5/14
2020/0315304 A1 * 10/2020 Humbert ..... A44C 5/145
2022/0202147 A1 * 6/2022 Einhorn ..... A44C 5/145
2022/0338600 A1 * 10/2022 Yamashita ..... A44C 5/14
2023/0000218 A1 * 1/2023 Sheng ..... A44C 5/14
2023/0019765 A1 * 1/2023 Kim ..... A44C 5/14
2023/0140150 A1 * 5/2023 Schaller ..... A44C 5/145 368/282
2023/0189942 A1 * 6/2023 Miyata ..... A44C 5/14 368/282
2024/0188693 A1 * 6/2024 Christian ..... G04B 37/1486
2025/0000217 A1 * 1/2025 Christian ..... G04B 37/1493
2025/0017332 A1 * 1/2025 Tanabe ..... A44C 5/14
2025/0098828 A1 * 3/2025 Einhorn ..... G04B 37/1486
2025/0185765 A1 * 6/2025 Bouchet ..... G04B 37/1486
2025/0185766 A1 * 6/2025 Jeong ..... A44C 5/145
2025/0194757 A1 * 6/2025 Noma ..... A44C 5/147
2025/0204654 A1 * 6/2025 Yamashita ..... A44C 5/147
2025/0221505 A1 * 7/2025 Lee ..... G04G 99/00

FOREIGN PATENT DOCUMENTS

CH 714409 A1 * 6/2019 ..... A44C 5/2071
CH 715276 A2 * 2/2020 ..... A44C 5/145
CH 719813 A2 * 12/2023 ..... A44C 5/14
CH 720830 A2 * 12/2024 ..... A44C 5/185
EP 2233026 A1 * 9/2010 ..... A44C 5/24
EP 2233026 B1 * 6/2012 ..... A44C 5/24
EP 3718429 A1 * 10/2020 ..... A44C 5/145
EP 4151116 A1 * 3/2023 ..... A44C 5/145
EP 3718429 B1 * 11/2023 ..... A44C 5/14
EP 4176756 B1 * 5/2024 ..... A44C 5/14
EP 4527237 A1 * 3/2025 ..... G04B 37/1486
JP 2013-508055 A 3/2013
JP 2019-37771 A 3/2019
JP 2020168366 A * 10/2020 ..... A44C 5/14
KR 101983472 B1 * 5/2019 ..... A44C 5/18
WO WO-2019111102 A1 * 6/2019 ..... A44C 5/0053

OTHER PUBLICATIONS

European Search Report issued Oct. 12, 2023 in European Application 23177457.1 filed on Jun. 6, 2023, 3 pages (with English Translation of Categories of Cited Documents).

* cited by examiner

INTERCHANGEABLE BUCKLE DEVICE

CROSS-REFERENCE TO RELATED APPLICATION

This application claims priority to European Patent Application No. 23177457.1 filed on Jun. 6, 2023, the entire disclosure of which is hereby incorporated herein by reference.

TECHNICAL SCOPE OF THE INVENTION

The present invention relates to the horological or jewellery field. More specifically, it relates to an interchangeable buckle device.

TECHNOLOGICAL BACKGROUND

Bracelets are typically made of leather or metal and have a buckle attached to them by means of a bar.

In the watchmaking industry, solutions have been proposed to allow users to easily change the bracelet on their watch, particularly in the case of replacement when it has become too worn, or to interchange a leather bracelet and a metal bracelet, for example. A great deal of effort has been devoted in recent years to improving these systems for disconnecting the bracelet from the case, and many solutions have been proposed.

However, the same effort has not been devoted to detaching the buckle, resulting in a lack of advantageous solutions. The value of a precious metal buckle or clasp is such that the wearer would like to be able to swap a bracelet without changing the buckle and in a simple, quick and safe manner, without the use of tools.

Another need that the invention addresses is that of allowing this bracelet to be replaced by bracelets that have not been modified in any way, i.e. standard bracelets, which is not the case with most of the solutions proposed to date.

More specifically, since the bracelet touches the wearer's wrist on this side of the strand, whereas it is most often at a distance therefrom on the side nearest the case because of the height of its assembly in relation to the watch, the latch piece of the bar rubs against the skin, which, apart from the resulting discomfort, exposes the pump bar system (made of a plurality of different metals) to the wearer's perspiration. The result is not only problems with product deterioration (oxidation or the like) but also increased allergy risks for the wearer, as materials containing nickel or other allergens are most often used.

Patent document U.S. Pat. No. 5,951,193 describes a method for assembling a buckle on a strand in which the bar cooperates with two resilient elements assembled in the bracelet, allowing the bar to be attached by sliding it into an elongated opening in the bracelet. This solution has a number of drawbacks when used to achieve universal interchangeability, since it requires a bracelet that has been modified in order to incorporate these assembly elements. This solution thus does not allow a buckle to be assembled on a standard bracelet, and thus limits interchangeability with commercially-available bracelets. Moreover, as the positions for assembling and removing the buckle in relation to the attachment element are in the direction of the bracelet's operating position, the buckle could come off when the watch is worn, particularly if it is worn fairly loosely or, in the case of a watch worn while diving over a neoprene-type wetsuit, when the thickness thereof shrinks and the bracelet becomes loose. Finally, the width of the hole receiving the bar is such that part of the hole remains visible after assembly, which is not only unsightly, but can also form a recess in which detritus can collect and disrupt the operation of the system.

Patent document CH714409 describes an interchangeable buckle and its assembly method in which the tongue must be moved along the axis of the bar in order to remove it, which requires the bracelet to be modified so that the opening intended to receive the tongue is wide enough to allow this movement. This solution is thus not universal, as it is only compatible with bracelets whose opening is wider than usual. Moreover, when the buckle is assembled and removed, the force exerted by the user on the tongue to compress the pump bar, which force is always exerted on the same side of the bracelet strand, results in deformation of the strand part, which increases the radial movement play of the tongue to the detriment of the security of the buckle and the aesthetics of the bracelet. Lastly, the buckle assembly/removal process does not provide a signal informing the user of correct assembly, such as a haptic and/or audible signal, which can present risks of incorrect assembly and thus unintentional detachment.

Patent document CH713108 describes a buckle device intended to be easily assembled and removed by clipping according to a rotation of a first element of the buckle relative to a second element of the buckle. This document presents an application for a folding clasp buckle, no embodiment for a tongue buckle being described or illustrated. However, it is advantageous to propose a device that can be applied to both a tongue buckle and a folding clasp buckle.

The fastening devices described are typically used for interchangeable bracelets, which can be replaced at the wearer's discretion. However, they are not without their drawbacks. In particular, they require major structural modifications to the bar, such as, for example, making an opening in the tube, or transforming the pistons. These changes lead to significant additional manufacturing costs.

SUMMARY OF THE INVENTION

The main aim of the invention is to overcome the various drawbacks of prior art devices.

More specifically, the aim of the invention is to provide a buckle that is easy to remove, easy to handle and applicable to new products, while remaining retro-compatible with existing products in order to adapt to standard, commercially-available bracelets.

To this end, the invention relates to an interchangeable buckle device comprising a buckle comprising a bar around which a tongue is articulated, the device comprising an insert provided with a channel arranged to receive the bar, and a latch arranged to cooperate with the insert so as to close the channel, the latch being arranged to slide from a locked position in which the bar is held in the channel to an open position in which the bar is free, the latch being held in its locked position by resilient return means.

According to other advantageous alternative embodiments of the invention:

- the insert comprises a recess intended to receive the latch, the recess also acting as a stop when the latch is in the open position;
- the channel comprises a passage for the tongue;
- the latch comprises a beak arranged to close the channel and hold the bar in the channel, the beak having a passage for the tongue;

the recess comprises, on internal side walls of the insert, guide grooves arranged to cooperate with pivot clicks integral with the latch;

the insert has blind holes arranged to receive the resilient return means, the blind holes facing the latch;

the latch comprises gripping means;

the insert comprises stop means for limiting the travel of the latch;

the resilient return means take the form of helical springs.

The invention further relates to a watch provided with an interchangeable buckle device in accordance with the invention.

BRIEF DESCRIPTION OF THE FIGURES

Other features and advantages of the invention will become apparent from the following detailed description, which is given by way of example and is by no means limiting, with reference to the accompanying drawings in which.

DETAILED DESCRIPTION OF THE INVENTION

Figure 1:
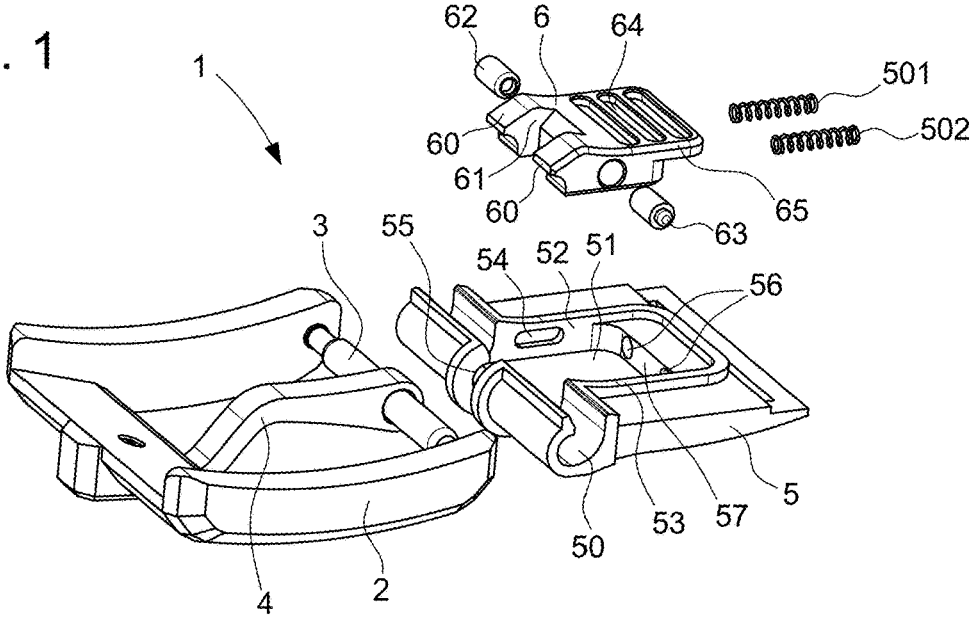
FIG. 1 shows an exploded perspective view of an interchangeable buckle device according to the invention.
Figure 2:
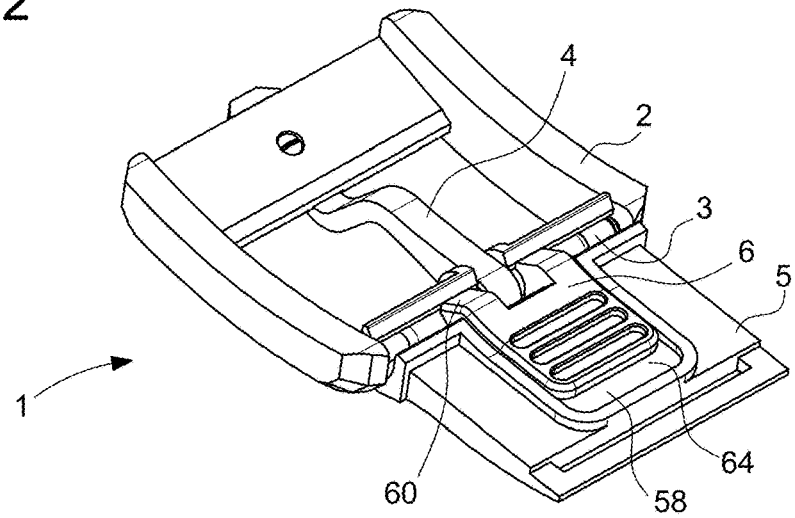
FIG. 2 shows a perspective view of an interchangeable buckle device according to the invention in the closed position.
Figure 3:
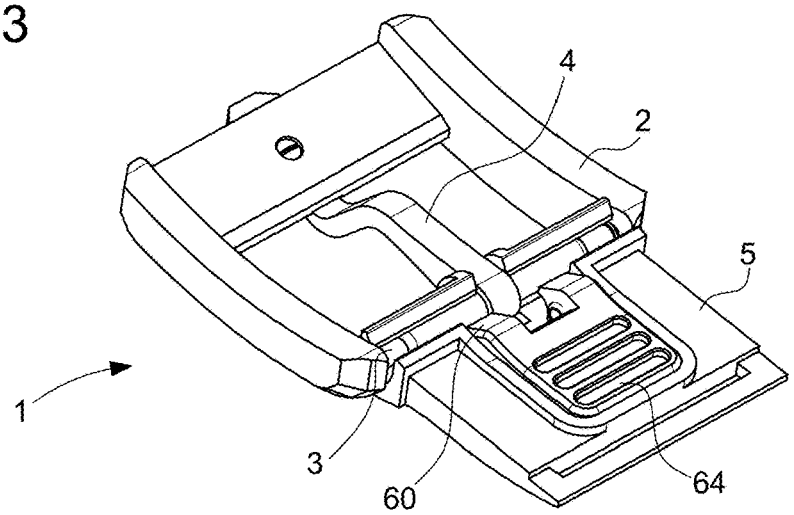
FIG. 3 shows a perspective view of an interchangeable buckle device according to the invention in the open position.

FIG. 1 illustrates an interchangeable buckle device according to the invention.

The interchangeable buckle device 1 is intended to attach and detach the end of a first bracelet strand to a watch buckle 3 fitted with a tongue 4 for attachment to a second bracelet strand.

Although only the example of a tongue buckle is described, such a device is also adaptable to stud buckles. A stud buckle is a buckle which resembles a tongue buckle but has no tongue, in which case a stud is used to secure the strand with which the tongue typically interacts.

The bracelet is fastened to the buckle by means of an interchangeable fastening device comprising a buckle 2 and a bar 3 around which a tongue 4 is articulated, the device comprising an insert 5 provided with a channel 50 arranged to receive the bar 3 by guiding it in the direction of its own axis (X). The "axis" of the bar is understood to refer to its own axis (X) of revolution or, if the body is not a perfect axisymmetric body, the axis along which the bar extends.

The device further comprises a latch 6 arranged to cooperate with the insert 5 so as to close off the channel 50. The latch 6 is arranged to move from a locked position in which the bar 3 is held in the channel 50 to an open position in which the bar 3 is free.

The latch 6 is held in its locked position by resilient return means 500, 510, a force opposing the return action of the springs enabling the latch to be moved to the open position, and thus constituting removable assembly means capable of making the buckle interchangeable.

As can be seen in FIG. 1, the channel 50 has a passage 55 for passing the tongue 4, an arrangement which allows the tongue 4 to pivot with the bar 3 when the device is in the locked position.

Thus, when the buckle system is assembled on a bracelet strand, the bar 3 is inserted into the channel 50 of the insert 5 and does not need to be modified.

The insert 5 comprises a recess 51 arranged to receive the latch 6, the latch moving from the locked position to the open position in the recess 51. The recess 51 is parallelepipedic in shape and has two inner side walls 52, 53, a rear wall 57 and a back. The recess 51 also opens into the channel 50 so that the latch 6 can hold the bar 3 in the channel 50 when the device is in the locked position.

The rear wall 57 comprises two blind holes 56 facing the latch 6 and arranged to receive the resilient return means, the resilient return means taking the form of helical springs 501, 502 and resting partially in the blind holes 56.

The internal side walls 52, 53 of the insert 5 have longitudinal guide grooves 54 arranged to cooperate with pivot clicks 62, 63 integral with the latch 6 and housed in the side walls of the latch 6. The length of the grooves makes it possible both to define the length of travel of the latch 6 and to hold it in the recess 51.

The recess 51 also acts as a stop when the latch 6 is in the open position. More specifically, the recess 51 has a shoulder 58 which forms a platform against which the latch 51 rests in part, the platform thus forming both a guide surface and a stop for the latch 6 when it is actuated.

The latch 6 has a first end comprising a beak 60 arranged to close the channel 50 and hold the bar 3 in the channel 50, and a second end resting against the platform of the shoulder 58. Advantageously, the beak 60 has a concave surface in order for its surface to complement the surface of the bar and limit contact points when the bar is pivoted. The beak 60 further includes a passage 61 for the tongue 4 so that it can pivot when the device is in the locked position.

It should be noted that the latch 6 comprises gripping elements 64 to increase grip and make it easier for the user to handle.

Figure 4A:
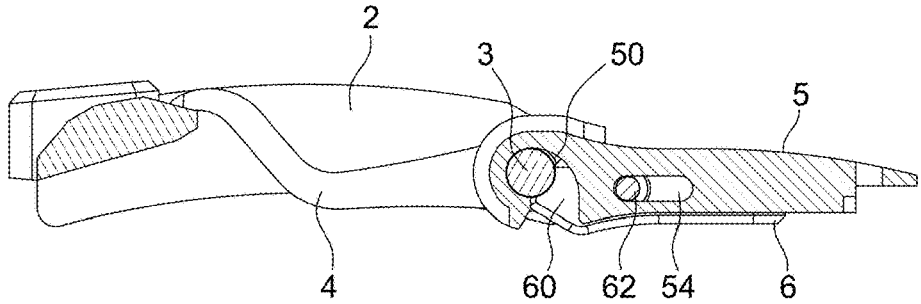
FIGS. 4*a* and 4*b* illustrate a cross-section of an interchangeable buckle device according to the invention in the closed position and in the open position respectively.

When the device is in the locked position, i.e. a position in which the bar rests in the channel 50 and is held there by the latch 6, the channel is closed off by the beak 60 of the latch as shown in FIG. 4*a*, in order to hold the bar 3 in position and prevent it from moving into a free position.

Figure 4B:
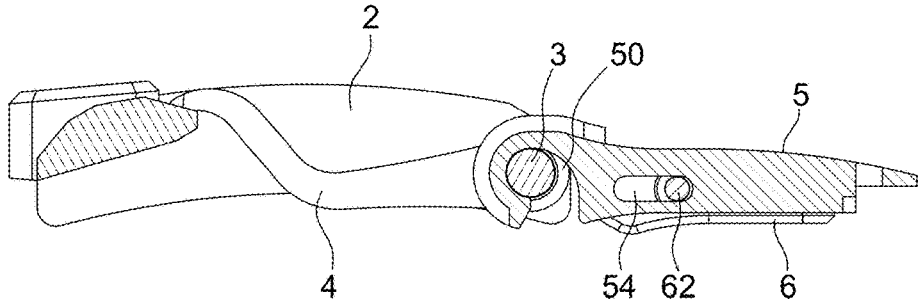

When moving to the open position, the latch 6 is displaced and translates in the direction of the length of the device, the latch 6 being guided by the displacement of the pivot clicks 62, 63 in the grooves 54 as shown in FIG. 4*b*. The latch 6 moves in the recess 51 and exerts a force on the springs 501, 502 which are then elastically deformed to leave the channel 50 open and allow the bar 3 to move from the locked position to a free position at a later time.

Figure 5:
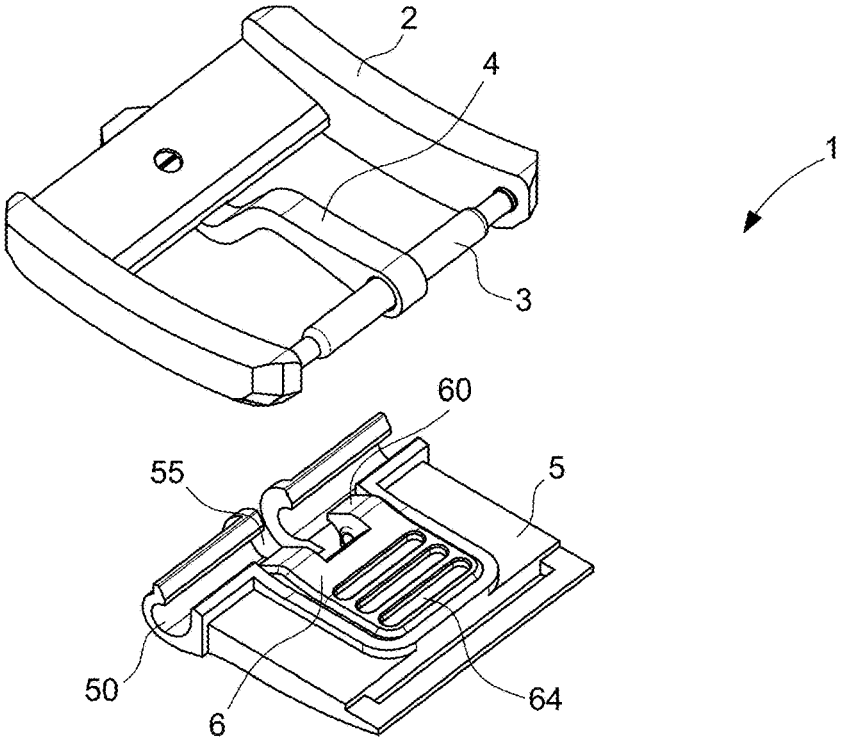
FIG. 5 shows a perspective view of an interchangeable buckle device according to the invention with the buckle released from the device.

Once the channel 50 is open, or free, the bar 3 can be unhooked from the device as shown in FIG. 5, and the user can change bracelets.

In the embodiment described above, the device is described for a so-called flexible bracelet made of leather, synthetic fabric or an elastomer material.

Thanks to these various aspects of the invention, a safe, interchangeable buckle device is obtained, which device allows bracelets to be changed easily and quickly without the need for tools.

It goes without saying that the present invention is not limited to the example illustrated and that various alternative embodiments and modifications which will become apparent to those skilled in the art may also be conceived.

The invention claimed is:

1. An interchangeable buckle device comprising a buckle provided with a bar around which a tongue is articulated, the device comprising an insert provided with a channel arranged to receive the bar, and a latch arranged to cooperate with the insert so as to close the channel, the latch being arranged to slide from a locked position wherein the bar is held in the channel to an open position wherein the bar is free, the latch being held in its locked position by resilient return means.

2. The interchangeable buckle device according to claim 1, wherein the insert comprises a recess intended to receive the latch, the recess also acting as a stop when the latch is in the open position.

3. The interchangeable buckle device according to claim 1, wherein the channel comprises a passage for the tongue.

4. The interchangeable buckle device according to claim 1, wherein the latch comprises a beak arranged to close the channel and hold the bar in the channel, the beak having a passage for the tongue.

5. The interchangeable buckle device according to claim 2, wherein the recess comprises, on internal side walls of the insert, guide grooves arranged to cooperate with pivot clicks integral with the latch.

6. The interchangeable buckle device according to claim 1, wherein the insert has blind holes arranged to receive the resilient return means, the blind holes facing the latch.

7. The interchangeable buckle device according to claim 1, wherein the insert comprises stop means for limiting the travel of the latch.

8. The interchangeable buckle device according to claim 1, wherein the resilient return means include helical springs.

9. A watch comprising an interchangeable buckle device according to claim 1.

10. The interchangeable buckle device according to claim 1, wherein, when moving from the locked position to the open position, the latch is configured to translate such that all of the latch moves away from the bar.

11. The interchangeable buckle device according to claim 1, wherein the resilient return means include two helical springs that are arranged in parallel to one another to each face the bar.

12. The interchangeable buckle device according to claim 1, wherein the latch comprises a beak at a first end, the beak being arranged to close the channel and hold the bar in the channel, and the latch comprises a second end opposite to the first end, the second end being in direct contact with the resilient return means.

* * * * *